US007448704B2

(12) United States Patent
Lam et al.

(10) Patent No.: US 7,448,704 B2
(45) Date of Patent: Nov. 11, 2008

(54) DRAWER GUIDE RAIL ASSEMBLY

(75) Inventors: Harn Lian Lam, Perak (MY); Harn Yan Lam, Perak (MY)

(73) Assignee: Harn Marketing SDN BHD, Ipoh, Perak (MY)

( * ) Notice: Subject to any disclaimer, the term of this patent is extended or adjusted under 35 U.S.C. 154(b) by 282 days.

(21) Appl. No.: 11/350,198

(22) Filed: Feb. 8, 2006

(65) Prior Publication Data

US 2006/0186773 A1 Aug. 24, 2006

(30) Foreign Application Priority Data

Feb. 21, 2005 (MY) ..... PI 20050661
Nov. 9, 2005 (MY) ..... PI 20055252

(51) Int. Cl.
*A47B 88/00* (2006.01)

(52) U.S. Cl. ..... 312/333; 312/334.46

(58) Field of Classification Search ..... 312/334.1, 312/330.1, 334.9, 334.19, 333, 334.46, 334.44, 312/334.45, 334.47

See application file for complete search history.

(56) References Cited

U.S. PATENT DOCUMENTS

| | | | | |
|---|---|---|---|---|
| 5,344,228 | A * | 9/1994 | Kovarik et al. | 312/334.9 |
| 5,433,517 | A | 7/1995 | Fleisch | |
| 5,484,199 | A * | 1/1996 | Gasser et al. | 312/334.33 |
| 5,988,780 | A | 11/1999 | Röck et al. | |
| 6,367,899 | B1 | 4/2002 | Hwang et al. | |
| 6,871,920 | B2 * | 3/2005 | Greenwald et al. | 312/334.4 |

FOREIGN PATENT DOCUMENTS

| | | | | |
|---|---|---|---|---|
| AT | 402779 B | | 8/1997 | |
| DE | 8228755 U1 | | 2/1983 | |
| DE | 4005405 A1 | | 10/1990 | |
| DE | 4028877 A1 | | 3/1991 | |
| DE | 4121225 A1 | | 1/1992 | |
| DE | 42 10 017 A1 | | 10/1992 | |
| DE | 9301344 U | | 5/1993 | |
| DE | 4410340 | | 10/1994 | |
| DE | 29621957 U | | 3/1997 | |
| DE | 19645628 A1 | | 6/1997 | |
| DE | 20116328 U1 | | 2/2002 | |
| DE | 20307757 U | | 7/2003 | |
| DE | 202004015908 U | | 12/2004 | |
| EP | 386731 | * | 9/1990 | 312/334.9 |
| JP | 04028308 | * | 1/1992 | 312/334.1 |

* cited by examiner

*Primary Examiner*—Hanh V Tran
(74) *Attorney, Agent, or Firm*—Volpe and Koenig P.C.

(57) ABSTRACT

A guide rail assembly is provided with a sliding movement synchronizing member. The assembly includes a fixed guide mounted on a support part, an intermediate rail slidable relative to the fixed guide and an outer pull out channel slidable on the intermediate rail. A rail protrusion is provided on either the fixed guide upper surface or the pull out channel bottom surface. The synchronizing member pivotally mounted on the intermediate rail includes first and second arms that extend in opposing directions from a central portion that contains the pivot point. Each of the arms has a roller that enables the member to travel along either the pull out channel bottom surface or the fixed guide upper surface. Its central portion interacts with the rail protrusion so as to interchangeably lock the intermediate rail with the pull out channel and with the fixed guide, during opening or closing of the assembly.

18 Claims, 11 Drawing Sheets

DRAWER GUIDE RAIL ASSEMBLY

This invention relates to a guide rail assembly for use in the furniture industry, and more particularly in a drawer that is slidably opened and closed.

Drawer guide rails are components in common every day use, such as for drawers in desks or cabinets, and for industrial use such as pull out storage shelves at a warehouse, cash registers at a supermarket, automated teller machines at banking kiosks, electronic equipment at telephone switching stations and so on.

DESCRIPTION OF THE PRIOR ART

Guide rail assemblies are provided for drawers to be either partially or fully opened or closed and typically consist of a bracket for fixing the assembly to the article of furniture, a fixed rail mounted on the bracket, a pull out rail attached to the side of the drawer, and preferably an intermediate rail in between the fixed and pull out rails. The intermediate rail is slidable over the fixed rail and the pull out rail is slidable over the intermediate rail due to slidable roller housings disposed within the fixed and pull out rails. Each of the fixed, intermediate and pull out rails is also normally disposed with pairs of limit stoppers. The distance traveled by the slidable roller housings between each pair of limit stoppers on each rail element typically defines the travel distance of each rail.

However, the slidable components, namely, the intermediate rail and pull out rail of guide rail assemblies of this typical construction are normally caused to slide in a non-sequential manner or in other words, it was not possible to control the sequence in which the pull out and intermediate rail became slidable. Generally, the sliding movement sequence depended on which one of the sliding components (either intermediate or pull out rail) of the guide rail assembly presented a lower frictional resistance. Also, often enough, both the intermediate and pull out rails begin to and continue to slide simultaneously. For example, in typical rail assemblies the intermediate rail is often moved along with the pull out rail when the drawer is pulled outward so as to be opened slightly i.e. not fully extended. In this case, the intermediate rail would have to be moved back past the extended drawer when the drawer is pushed closed, inevitably resulting in the limit stoppers of the pull out and fixed rails striking against each other, therefore causing unnecessary and undesirable noise. In another scenario that often arises in a typical rail assembly, the intermediate rail is caused to be slidably moved along when the drawer is opened slightly. This would undesirably result in the intermediate rail becoming visible to the user.

Therefore, it would be desirable to control the sequence in which the three components of the guide rail assembly, namely, the fixed, intermediate and pull out rails become slidable relative to each other. Prior drawer guide rail assemblies where these three rail components are permanently coupled to each other by way of gears or friction couplings have been provided in the past with these rail assemblies of this type being generally expensive to produce and manufacture and prone to frequent malfunction and failure.

In order to overcome the above-stated problems, an existing drawer sliding guide rail system with a rail sequencing mechanism is disclosed in U.S. Pat. No. 5,433,517. The prior system of this US patent comprises a stationary cabinet slide, an intermediate slide guided and slidable on the cabinet slide via a roller mounted on the cabinet slide as well as a drawer slide guided and slidable on the intermediate slide via a roller mounted on the intermediate rail. The sequencing mechanism of this prior system consists of a coupling element arranged on and close to the forward end of the intermediate slide as well as abutment devices arranged on the cabinet and drawer slides such that they are disposed to cooperate with the coupling element.

The coupling element of this prior system is a shaped, pivotal snap-action locking member having a plurality of stop-surfaces and eyelet-shaped spring extending from a stop and defining a receiving recess at an end. This coupling element is engaged in or 'wedged into' an opening close to the forward end of the intermediate slide. The cabinet slide has a pin that, when this prior system is in use, can be wedged between the locking member and spring recess, thereby engaging and biasing the spring. Abutment devices disposed on the upper surface of the drawer slide are contactable with the stop-surfaces of the locking member.

The sliding movement of the three slide elements (cabinet, intermediate and drawer slides) of this prior system is sequenced by way of having the coupling element disposed on the intermediate slide, pivot between two end positions thereby locking the intermediate slide selectively to either the cabinet or the drawer slides. Engagement of the cabinet slide pin within the spring recess of the locking member causes biasing of the eyelet-shaped spring and locking or anchoring of the intermediate slide to the stationary cabinet slide. When the drawer slide is extended (drawer pulled open), the upwardly projecting abutment device engages a face of the locking member, pivoting the locking member until it is released from its engagement with the pin, i.e. freeing the intermediate slide from the stationary cabinet slide. As can be envisioned, this process is reversed when the drawer slide is retracted (drawer pushed close). Basically, the sequencing of the slide movements for the three slide elements of this prior system depend very much on the resiliency of the eyelet-shaped spring and proper contact or engagement between the cabinet slide pin and the recess of the locking member as well as engagement and stop-surfaces of the locking member with the upwardly projecting abutment devices of the drawer slide.

Due to the above-described structure and manner in which the coupling element is disposed to interact with the slide elements, this is an ineffective method of sequencing the sliding movement, especially when great or excessive force is used to either push in or pull out the drawer or when a heavy load is carried by the drawer, in which case the eyelet-shaped spring may be biased past its resilient limits. Frequent, sustained or vigorous usage over long periods of time may also cause the coupling member to be disengaged from the intermediate slide. Additionally, the structure of this prior sequencing mechanism also causes the assembly of this drawer slide system to become unnecessarily complicated and would require a significant amount of time.

This invention thus aims to alleviate some or all of the problems of the prior art, and to provide a sliding guide rail assembly having a synchronizing member that is easily assembled and manufactured, practical, versatile and allows for vigorous and sustained usage.

SUMMARY OF THE INVENTION

In accordance with an aspect of the invention, a guide rail assembly having a synchronized sliding movement for slidably opening and closing a drawer within an article of furniture is provided. The assembly comprises a support means for fixing the assembly to the article of furniture; a fixed guide mounted on the support means for receiving an intermediate pull out rail; an intermediate pull out rail capable of sliding back and forth relative to the fixed guide; and an outer pull out channel for attachment to the drawer and being capable of sliding back and forth on the intermediate pull out rail relative to said outer pull out channel and the fixed guide. The outer pull out channel has a protrusion on the bottom surface, wherein the protrusion projects into the space within the intermediate pull out rail and a synchronizing member is pivotably mounted on the intermediate rail. The synchronizing member comprises a forwardly-extending first arm and a rearwardly-extending second arm that extend in generally opposing directions from a central portion that contains the pivot point, each of the arms terminating in a respective roller that enables the synchronizing member to travel along the upper surface of the fixed guide. The first arm includes a bend to define an elbow, wherein the central portion is adapted to interact with the protrusion so as to switch the synchronizing member, during an open or closing action of the assembly, between a first condition in which the elbow of the first arm engages the forward end of the fixed guide and locks the intermediate rail to the fixed guide, and a second condition in which the central portion is engaged by the protrusion to lock the pull out guide to the intermediate rail.

In an embodiment of this aspect, the rearwardly-extending second arm of the synchronizing member is pivotable relative to the central portion about a second pivot point and is biased to a position such that its terminal roller is contactable with the upper surface of the fixed guide. The biasing means may comprise a removable spring or a resiliently deformable portion of the synchronizing member.

In another embodiment, the central portion of the synchronizing member further comprises a protruding knob-like portion engagable with a longitudinal end of the protrusion on the bottom surface of the outer pull out channel.

In a further embodiment, the forward end of the fixed guide further comprises a resilient damping part that is engaged by the forwardly-extending first arm in its first condition.

According to another embodiment, the protrusion on the bottom surface of the outer pull out channel is integral to the outer pull out channel.

According to yet another embodiment, the protrusion on the bottom surface of the outer pull out channel further comprises a guide ramp on each longitudinal end.

In a preferred aspect of the invention, a guide rail assembly having a synchronized sliding movement for slidably opening and closing a drawer within an article of furniture is provided. The assembly comprises a support means for fixing said assembly to the article of furniture; a fixed guide mounted on the support means and for receiving an intermediate pull out rail, and having a protrusion on the upper surface of said fixed guide, wherein the protrusion projects into the space within the intermediate pull out rail; an intermediate pull out rail capable of sliding back and forth relative to the fixed guide; and an outer pull out channel for attachment to the drawer and being capable of sliding back and forth on the intermediate pull out rail relative to the intermediate pull out rail and the fixed guide. A synchronizing member is pivotably mounted on the intermediate rail, the synchronizing member comprising a forwardly-extending second arm and a rearwardly-extending first arm that extend in generally opposing directions from a central portion that contains the pivot point. Each of the arms terminates in a respective roller that enables the synchronizing member to travel along the bottom surface of the outer pull out channel, and the rearwardly-extending first arm includes a bend to define an elbow. The central portion is adapted to interact with the protrusion so as to switch the synchronizing member, during an open or closing action of the assembly, between a first condition in which the elbow of the first arm engages the rear end of the outer pull out channel and locks the outer pull out channel to the intermediate rail, and a second condition in which the central portion is engaged by the protrusion to lock the intermediate rail to the fixed guide.

In an embodiment of the preferred aspect, the forwardly-extending second arm of the synchronizing member is pivotable relative to the central portion about a second pivot point and is biased to a position such that its terminal roller is contactable with the lower surface of the outer pull out channel. The biasing means may comprise a removable spring or a resiliently deformable portion of the synchronizing member.

According to another embodiment, the central portion of the synchronizing member further comprises a protruding knob-like portion engagable with a longitudinal end of the protrusion on the upper surface of the fixed guide.

In a further embodiment, the rear end of the outer pull out guide further comprises a resilient damping part that is engaged by the rearwardly-extending first arm in said first condition.

In yet another embodiment, the protrusion on the upper surface of the fixed guide is integral to the fixed guide.

According to a further embodiment, the protrusion on the upper surface of the fixed guide further comprises a guide ramp on each longitudinal end.

In an embodiment of both aspects of the invention, the intermediate pull out rail has an I-shaped vertical cross-section.

In another embodiment of both aspects of the invention, the fixed guide and outer pull out channel each further comprises a slidable housing having a plurality of rollers that enables the intermediate rail to be slidable on the fixed guide and the outer pull out channel to be in turn slidable on the intermediate rail.

The objective of the sliding guide rail assembly having a synchronizing member of this invention is to provide a configuration that causes the sliding movements of the slidable outer pull out channel and intermediate rail to be effectively synchronized in sequence. As is apparent from the preceding paragraphs, due to the structure and shape of the synchronizing member of this invention, it efficiently stabilizes, controls, guides and synchronizes the sliding movement of the pull out channel and intermediate rail over a relatively larger surface area in comparison with that of the prior devices. This is due to the fact that the first and second arms of the synchronizing members are horizontally spaced apart by the central portion, thereby resulting in the synchronizing member spanning over a greater length of any of the rail elements at any given time. This configuration of the synchronizing member would also allow it to be effective without failing even if excessive force is used when pushing in or pulling out the drawer or a heavy drawer load is carried.

Furthermore, the intermediate rail is prevented from 'over sliding' past a desired distance therefore diminishing the efficiency of the guide rail assembly and sometimes becoming visible to the user at a drawer front. This is due to the 'anchoring mechanism' provided by the synchronizing member of this guide rail assembly which anchors the intermediate rail to the fixed guide in a preferred aspect and to the outer pull out channel in another aspect of the invention.

The shape and construction of the synchronizing member also makes it more robust in comparison with the prior devices in that it is of a majority rigid construction with a minority flexible portion. It is not entirely reliant on its deformable portion (biasing means on its second arm i.e. whether removable spring or resilient deformable portion) for its flexibility as it is pivotably mounted on the intermediate rail via the first pivot point of its central portion and may also comprise a second pivot point for the pivoting movement of its second arm. This would obviously aid in longer, more sustained and vigorous usage of the guide rail assembly having this synchronizing member without physical failure of its essential synchronizing component The possibility of removability of the deformable portion of the synchronizing member allows for the possibility of replacing only that portion in the event of physical failure due to for example, the biasing means losing its resilient capability. Also, this allows for the structurally rigid first arm and central portion to be made from robust material, for example, metal, while the deformable second arm may be made from a resilient material such as plastic or rubber or have a removable spring. In this way, structural integrity and load efficiency of the synchronizing member and by extrapolation the guide rail assembly incorporating this synchronizing member are not compromised.

The guide rail assembly of this invention is also easily assembled by an ordinary user and its assembly thereof does not require specialized tools or skills. Additionally, due to its relatively simple construction and assembly, it is relatively cost effective to manufacture.

BRIEF DESCRIPTION OF THE DRAWINGS

The invention is illustrated, although not limited, by the following description of embodiments made with reference to the accompanying drawings in which.

DETAILED DESCRIPTION OF THE EMBODIMENTS

Figure 1:
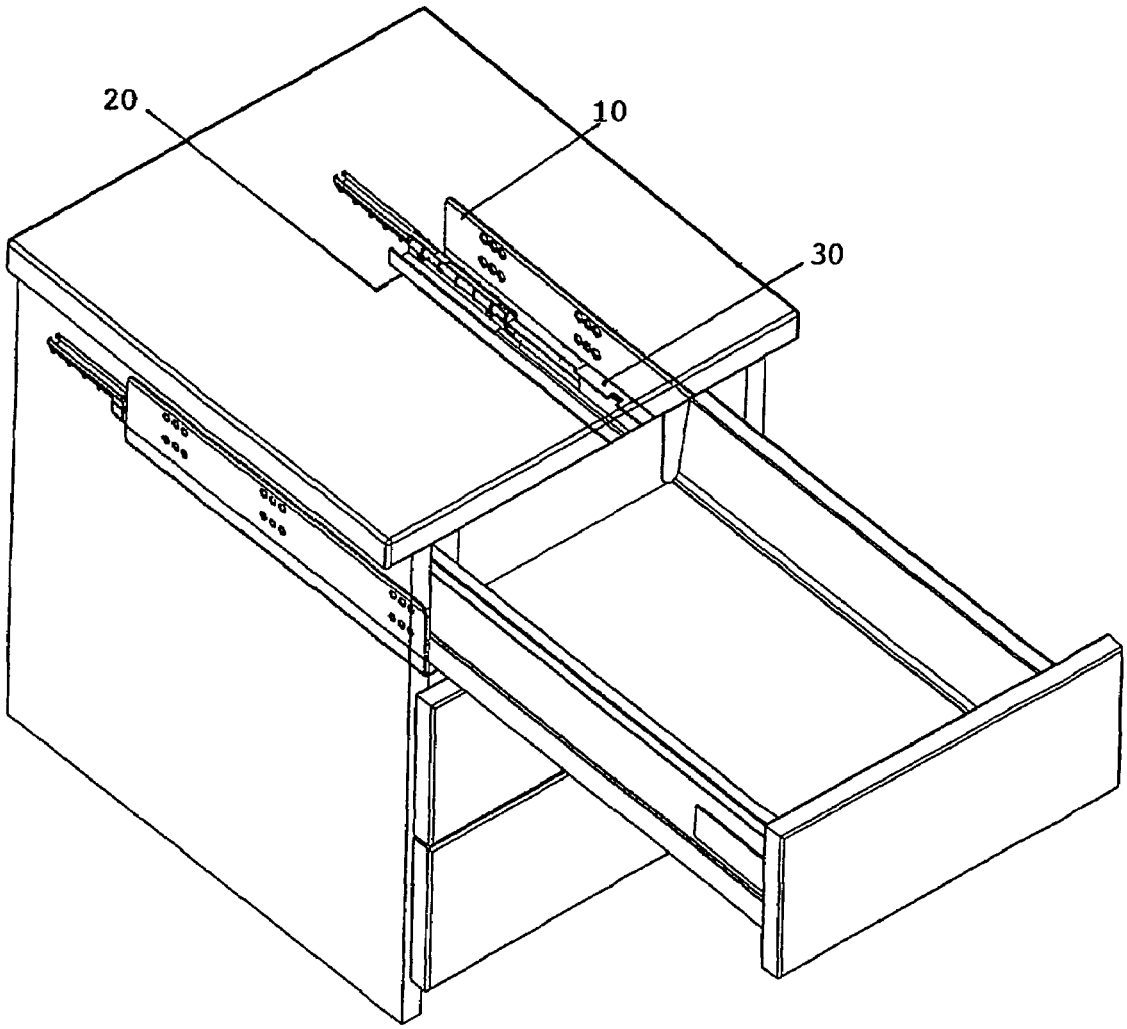
FIG. 1 illustrates a drawer having a sliding guide-rail assembly in accordance with the present invention within an article of furniture.
Figure 2:
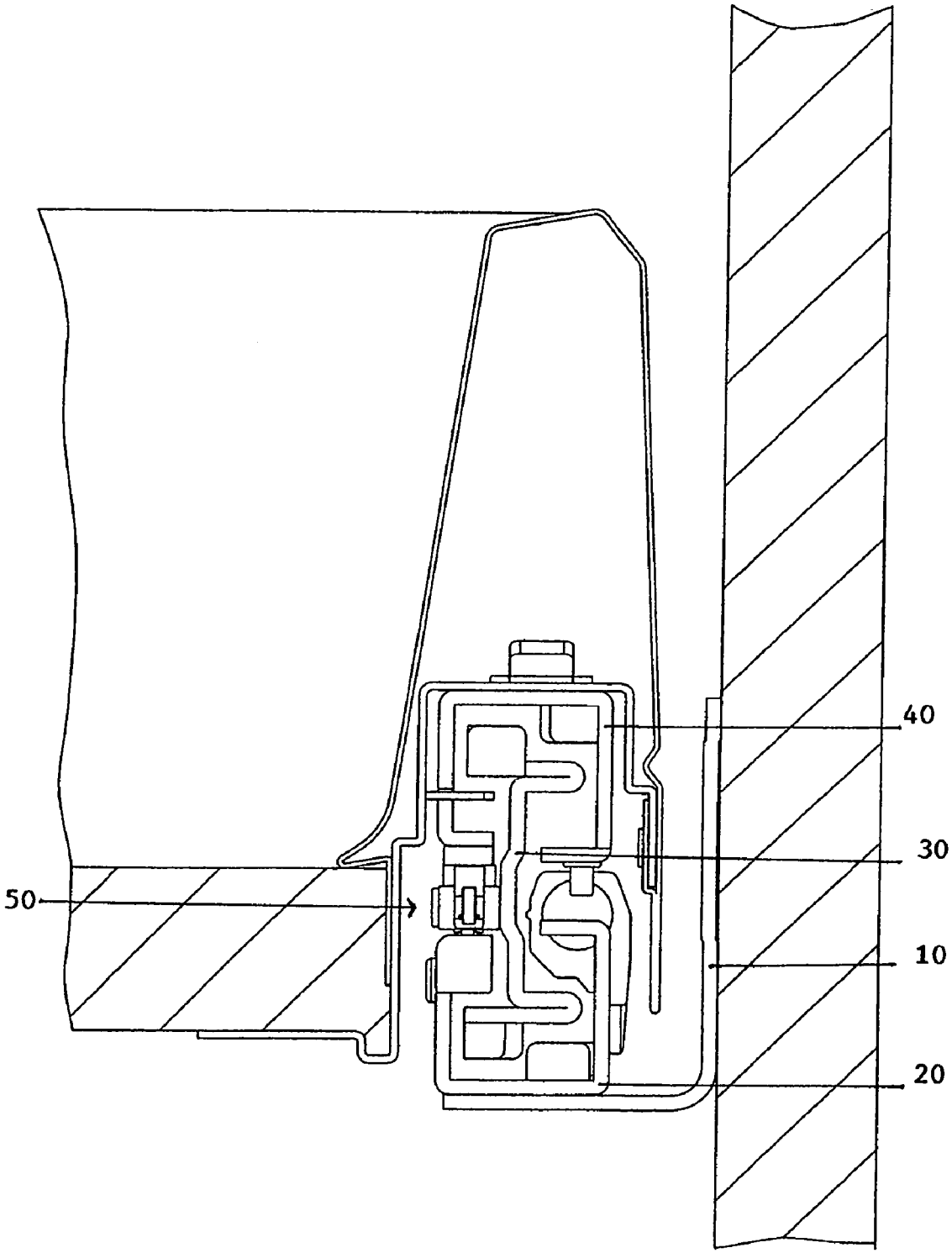
FIG. 2 shows a sectional view of a preferred embodiment of the invention.

FIG. 1 shows a sliding guide rail assembly having synchronizing member assembled and attached to each side of a drawer within an article of furniture. The sliding guide rail assembly comprises of a support means 10 for fixing the assembly to the article of furniture, a fixed guide 20 mounted on the support means 10, an intermediate pull out rail 30 and an outer pull out channel 40 secured to the drawer side. The fixed guide 20 and outer pull out channel 40 each have a slidable housing 70 having a plurality of rollers, which enables the intermediate rail 30 to be slidable on the fixed guide 20 and the outer pull out channel 40 to be in turn slidable on the intermediate rail 30, in the preferred aspect of the invention, as shown in FIG. 2. In this embodiment, the intermediate rail 30 is I-shaped and has a synchronizing member 50, 60 pivotably attached to its central vertical web on a side facing the side of the drawer on which the guide rail assembly is attached. In the preferred embodiment, the fixed guide 20 has a protrusion 21 on its upper surface and the outer pull out channel 40 has a damping part 43 disposed on its rear end for engagement with the synchronizing member 50, 60.

Figure 3:
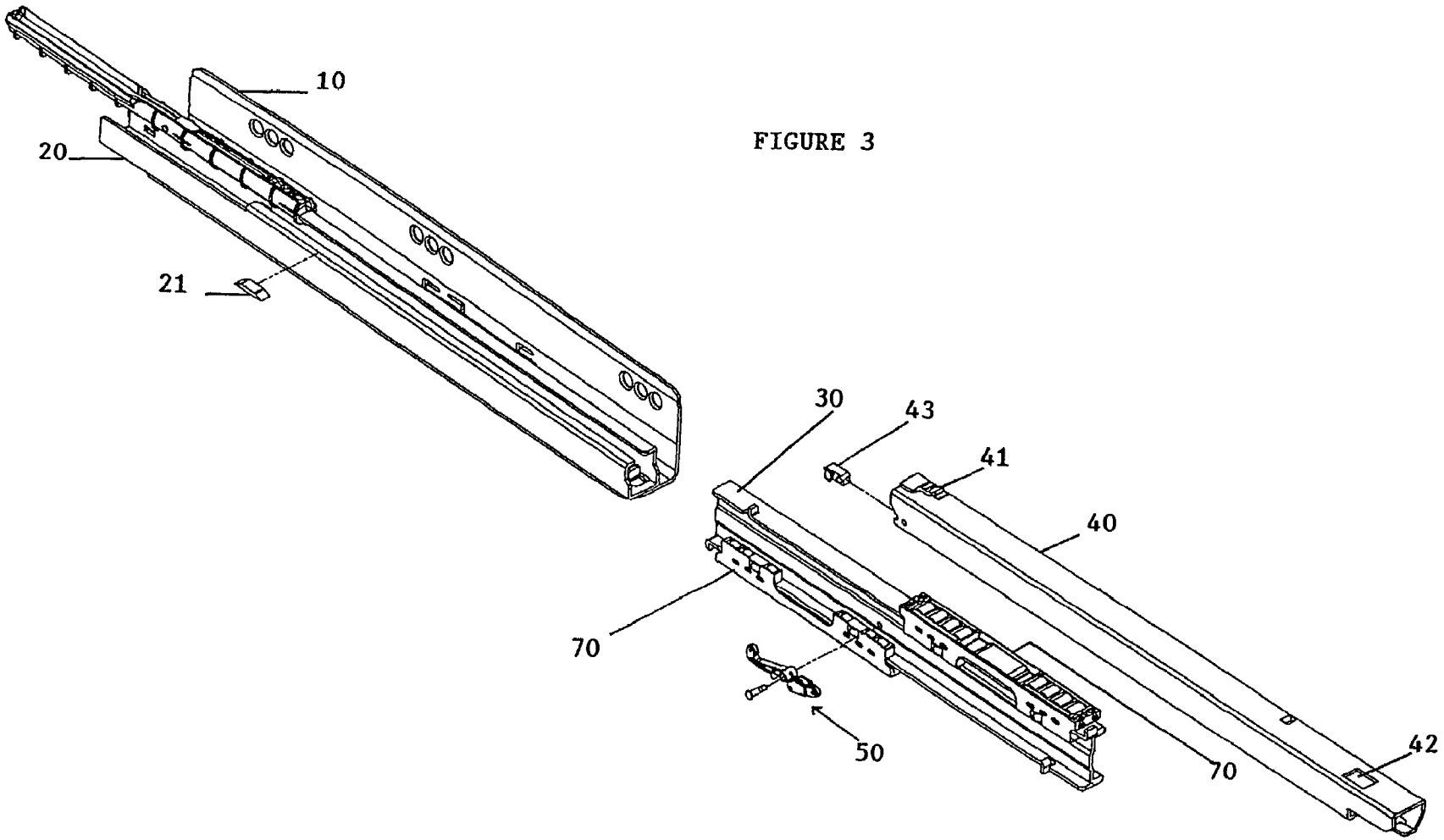
FIG. 3 shows an exploded view of the parts of a preferred embodiment of the invention.

FIG. 3 shows a support means 10 is formed from a sheet metal into a substantially L-section comprising of a vertical flange and a horizontal flange. The vertical flange has a multitude of holes for fixing to the side of an article of furniture such as a cabinet or chassis into which a drawer or equipment is to be installed in. Stepped edges are also formed on this vertical flange in order to increase its rigidity. Similarly, notches are formed at the bent edge of the L-section for increasing the rigidity and load capacity of this support means. The fixed guide 20 of the assembly is attached onto the horizontal flange of the support means 10.

This fixed guide 20 is formed from sheet metal into an open C-section. Stops consisting of punched-out tabs that are bent inwardly are formed at either or opposite sides towards the longitudinal ends of the guide. Slidably fitted inside this fixed guide 20 is a sliding housing 70 having rollers wherein this sliding housing runs smoothly on its rollers inside the guide between the stops. The bottom surface of the fixed guide 20 is provided with fastening means (not shown) adapted for mounting on the horizontal flange of the support means. A protrusion 21 having a trapezium-like shape with guide ramps on each of its longitudinal ends is disposed on the upper surface towards the rear (relative to drawer orientation) of this fixed guide 20. This protrusion 21 may be made of any material and projects into the space within the intermediate pull out rail 30. This protrusion may also act as a retainer means for the guide rail assembly during the operational motion thereof.

The intermediate rail 30 is formed from sheet metal into a substantially I-section or alternatively a composite of two Ts with upper and lower horizontal flanges with a vertical web. The bent edges of the upper and lower flanges are either on the same side as each other or at opposite sides. Two pairs of stops are formed spaced apart on the upper and lower surfaces of the lower and upper flanges respectively that may again consist of inwardly bent punched-out tabs. This intermediate rail 30 may be installed with no distinction as to which end is forward. Also, this rail 30 may be provided with the punched-out tabs of stops not yet bent so that these tabs may be bent in the required direction during assembly or installation. This would allow for flexibility during assembly of this system and also advantageously reduces the number of parts required for stocking. This intermediate rail 30 also has a synchronizing member 50, 60 pivotably attached to the side of its vertical web facing the side of the drawer on which the guide rail assembly is attached.

Figure 4:
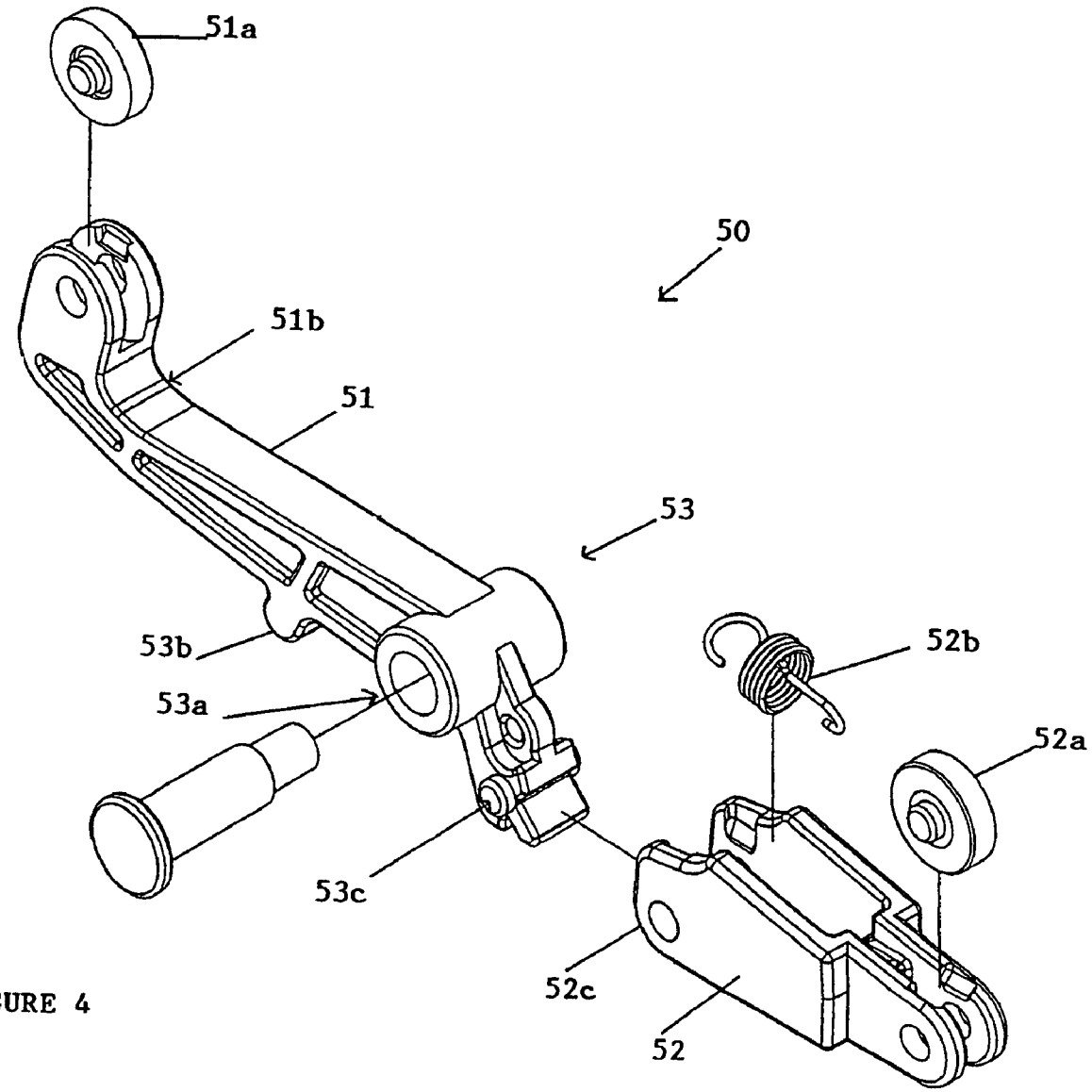
FIG. 4 shows the synchronizing member of a preferred embodiment of the invention.
Figure 5A:
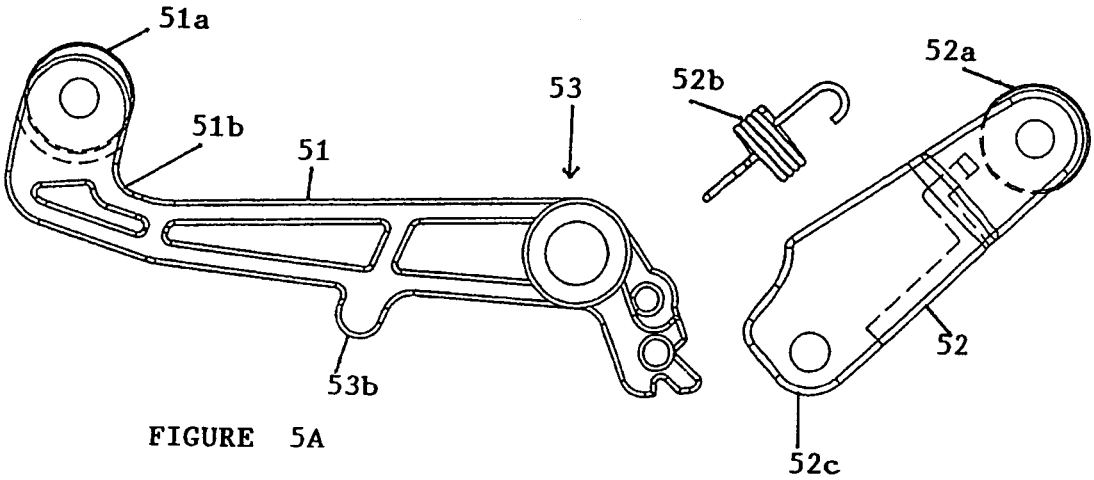
FIGS. 5A to 5C shows a side view of the synchronizing member of FIG. 4 as it is assembled.
Figure 5B:
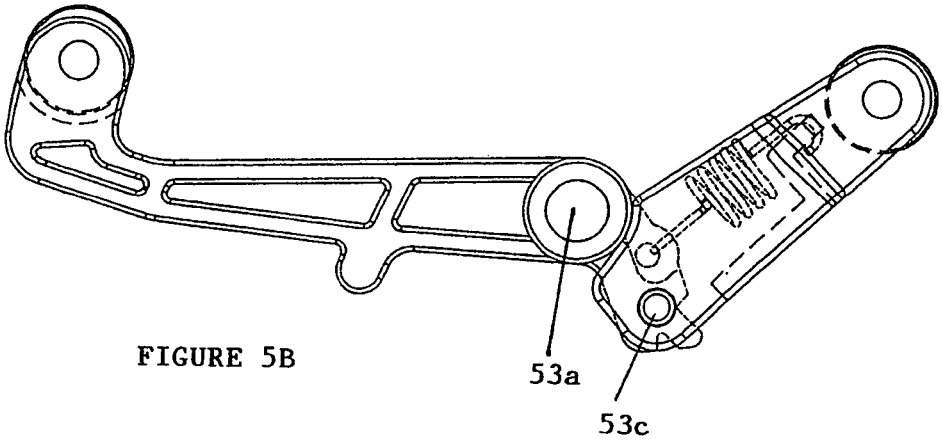
Figure 5C:
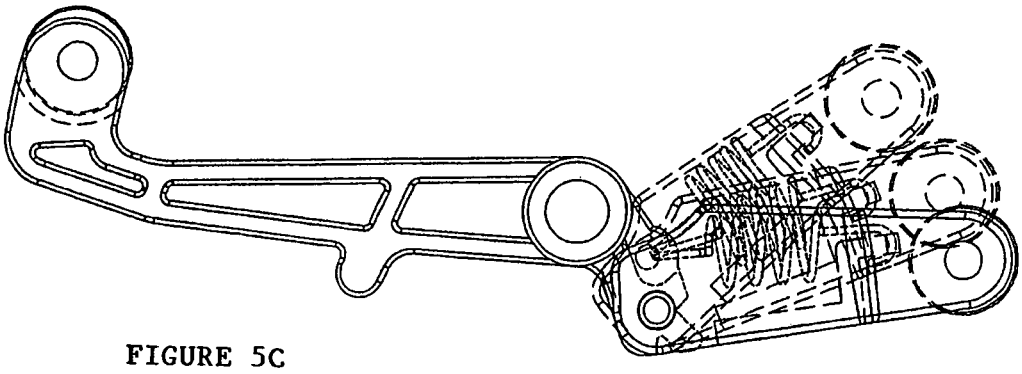
Figure 6:
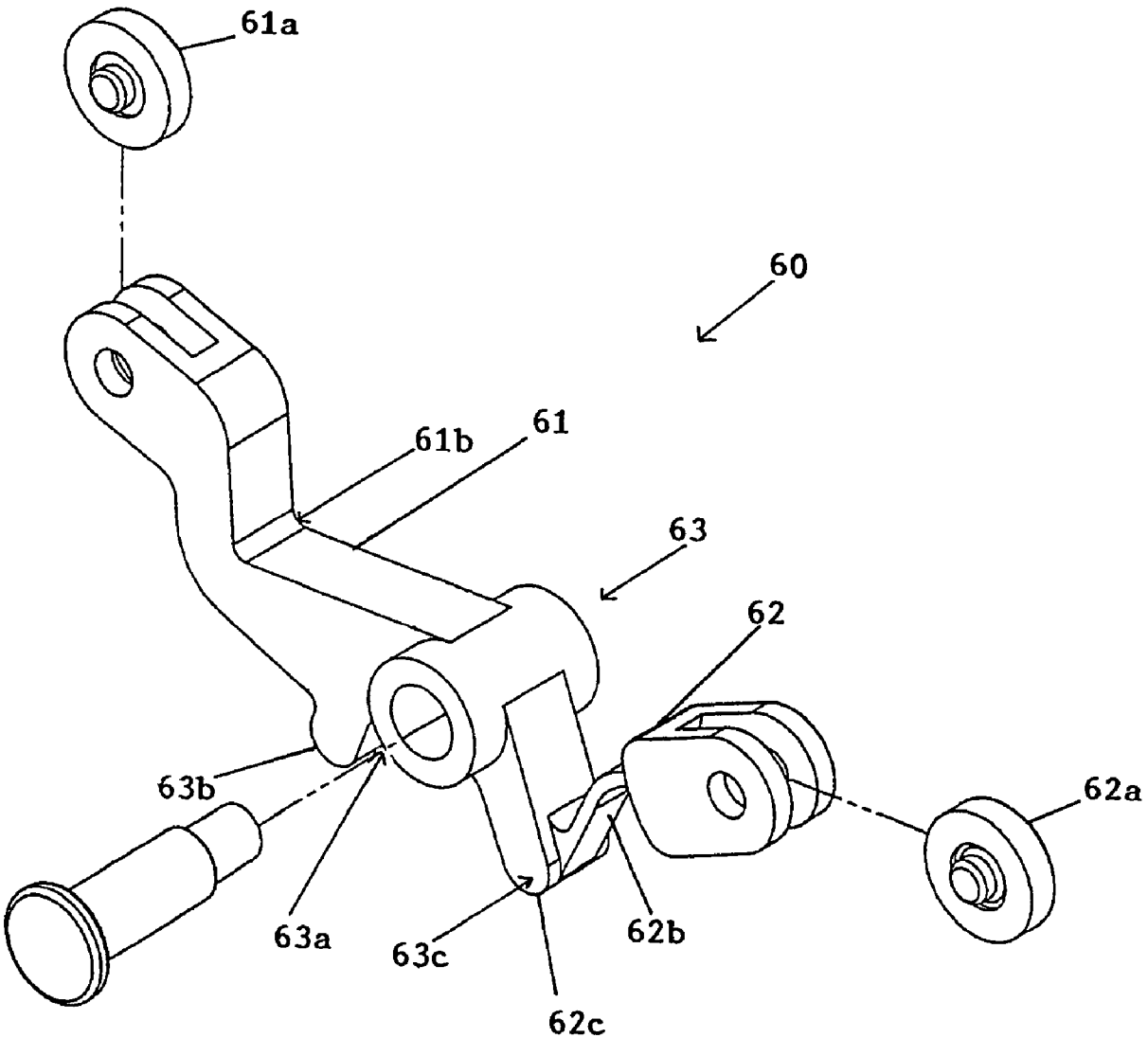
FIG. 6 shows the synchronizing member of another embodiment of the invention.

As seen in FIGS. 4 to 6, the synchronizing member 50, 60 comprises a rearwardly-extending first arm 51, 61 and a forwardly-extending second arm 52, 62 that extend in generally opposing directions from a central portion 53, 63. Each of the first 51, 61 and second 52, 62 arms has respective terminal rollers 51*a*, 52*a*; 61*a*, 62*a* that enable the synchronizing member 50, 60 to travel along the bottom surface of the pull out channel 40. The central portion 53, 63 contains the pivot point 53*a*, 63*a* where the synchronizing member is pivotably attached to the side of the intermediate rail vertical web via a pin or the like. Also, the central portion 53, 63 is configured to have an angled contour relative to the first arm 51, 61 and is adapted to interact with the protrusion 21 of the fixed guide 20 via a protruding knob-like portion 53*b*, 63*b* that is engagable with a guide ramp of a longitudinal end of the fixed guide-protrusion 21. The first arm 51, 61 includes a bend 51*b*, 61*b* that defines an elbow/distal arm portion that is engagable with the rear end of the outer pull out channel 40. Also, the first arm 51, 61 extends upwardly relative to the central portion 53, 63. The second arm 52, 62 is preferably removably pivoted to the central portion 53, 63 about a second pivot point 53*c*, 63*c* and is biased to a position such that its terminal roller 52*a*, 62*a* is contactable, in use, with the bottom surface of the pull out channel 40. In this biased position, the end 52*c*, 62*c* of the second arm 52, 62 opposite its terminal roller is rounded and engagable with a longitudinal end of the fixed guide protrusion 21. It is also preferred that the biasing means comprises a removable spring 52*b* that enables the second arm to flexibly mesh with and angularly project (approximately 20°) from the central portion 53, as shown in FIGS. 5A, 5B and 5C. However alternatively, as seen in FIG. 6, the second arm 62 may be pivotably attached to the central portion 63 about a second pivot point 63*c* and biased to a similar position as above-described. In this alternative case, the second arm 62 has resiliently deformable portion 62*b* so that it retains the necessary flexible nature.

The outer pull-out channel 40 is formed from a sheet metal into an open C-section. On either side of this pull out channel 40 are two stops disposed such that each stop is located towards a longitudinal end of the guide. These stops consist of punched-out tabs that bend inwardly. An L-shaped extension 41 is cut or formed on the upper surface of this pull out channel. This extension engages with an attachment (not shown) on the drawer side for fixing this pull out channel to the drawer. An aperture 42 is also punched on the upper surface of this pull out channel at the front end (relative to drawer orientation) to allow for engagement with a catch (not shown) mounted at the front of the drawer side. This allows for the drawer to be easily and removably attached with the outer pull out channel 40. Slidably fitted inside this pull out channel is a sliding housing 70 having rollers wherein this sliding housing runs smoothly on its rollers inside the pull out channel between the stops. Additionally, this outer pull out channel 40 has a resilient damping part 43 at its rear end that is engagable by the rearwardly-extending first arm 51, 61 (for example, its terminal roller 52*a*) of the synchronizing member 50, 60. This damping part 43 may be made of any type of material that is resilient in nature and functions to dampen or eliminate the noise made when the first arm 51, 61 of the synchronizing member 50, 60 is engaged therewith.

The sliding housings 70 of both the fixed guide 20 and outer pull out channel 40 are of a similar construction and comprise a long member having a substantially rectangular cross-section with a hollow central recess in the form of an open T. Rollers are provided at the upper part and both sides of the T. The side rollers are vertically displaced by a distance substantially equal to the thickness of the vertical web of the intermediate rail 30. The number, type (whether upper or side rollers) and configuration of rollers depend on the load capacity for which the sliding housings are designed for. Further side rollers (not shown) that provide lateral guidance for the drawer/equipment may also be provided, wherein when these rollers are spaced as far apart as possible, greater lateral stability is provided. The open T-shaped recess of the intermediate rail-sliding housing enables the intermediate rail to be slidable on the fixed guide with the lower flange of the rail slidably fitted therein. Similarly, the open T-shaped recess of the outer pull out channel-sliding housing enables the pull out channel to be slidable on the intermediate rail with the upper flange of the rail slidably fitted therein. Adequate clearances are provided between the upper rollers and the respective contact surfaces of both the upper and lower flanges of the intermediate railing for ease of alignment and/or assembly. Similarly, adequate clearances are provided between side rollers and the contact surfaces of the vertical web of the intermediate rail.

Figure 7:
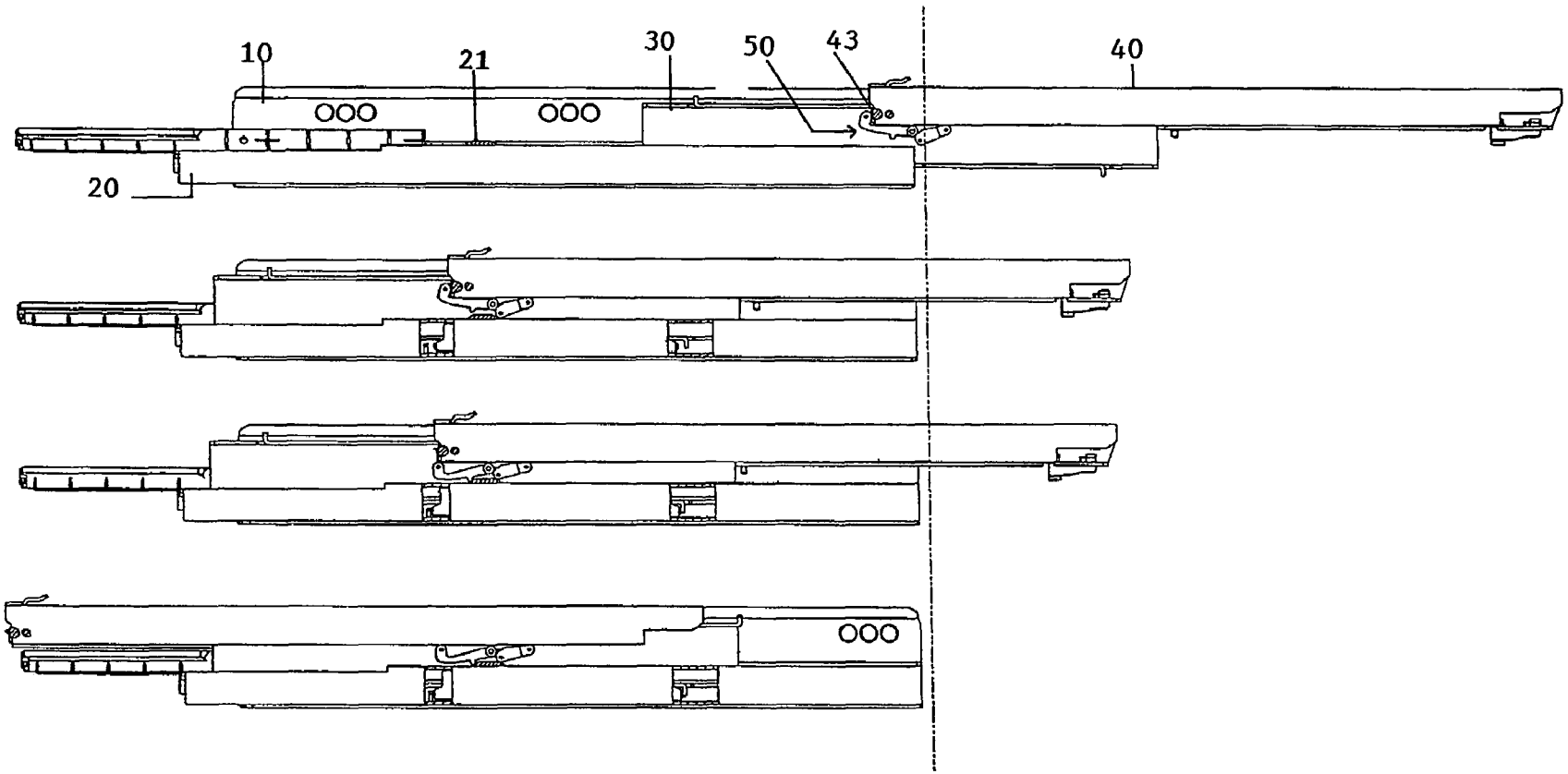
FIG. 7 shows a side view of a preferred embodiment of the invention as the drawer is initially in a fully opened position and subsequently being pushed into a completely closed position.
Figure 8:
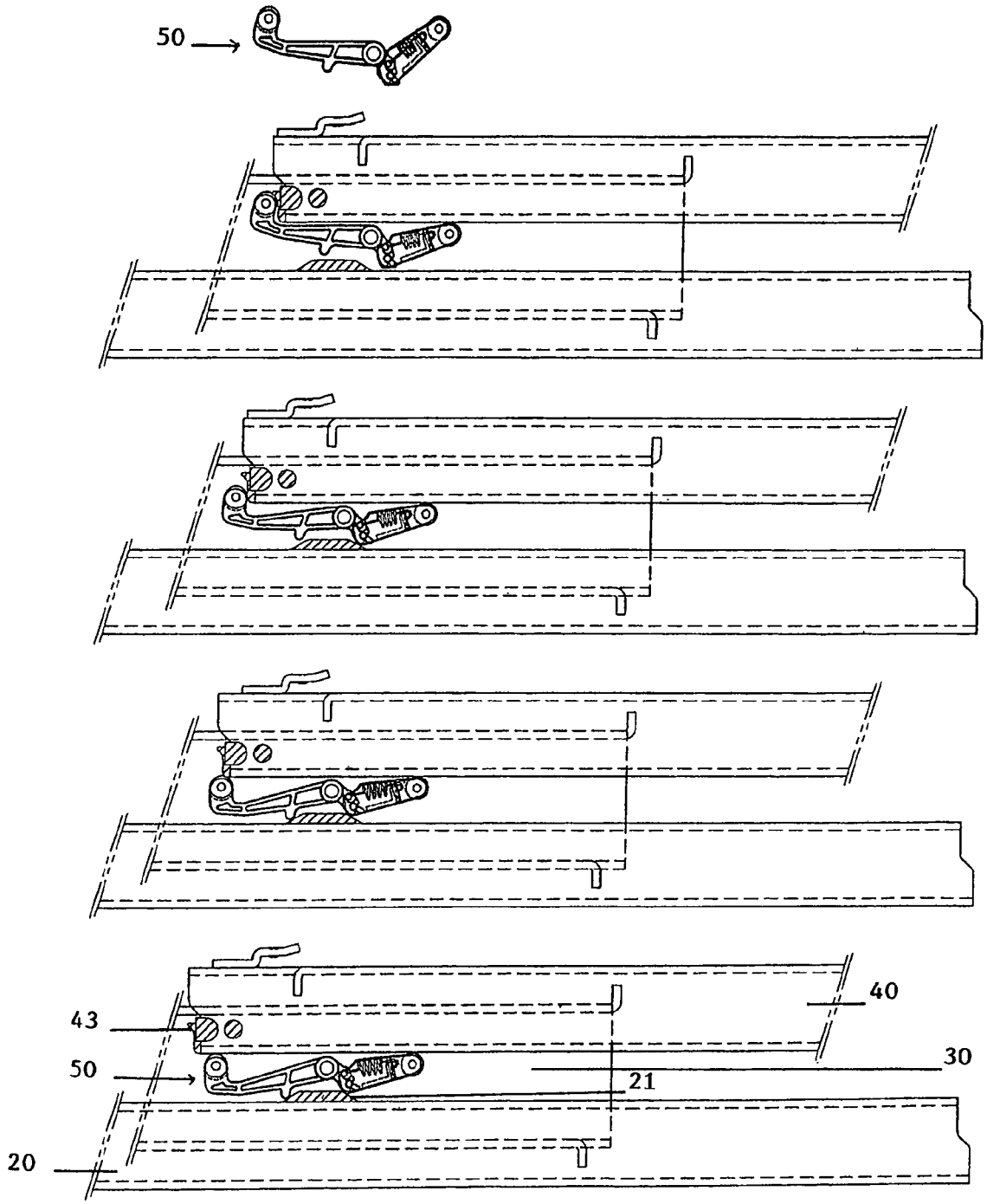
FIG. 8 is a close-up of the engagement of the synchronizing member with the rear end of the outer pull out channel in the aspect of FIG. 7.

In use, as seen in FIGS. 7 and 8, when the drawer is being pulled out or pushed in from a fully closed or fully extended position, into the article of furniture, the guide rail assembly having the synchronizing member disposed therein provides a synchronized sliding motion such that the intermediate rail 30 and outer pull out channel 40 are slidable over each other in a sequential manner. When the drawer is in a fully extended position, the synchronizing member 50, 60 of the intermediate rail 30 is in a first condition in which the elbow 51*b*, 61*b* of the rearwardly-extending first arm 51, 61 is engaged with the rear end of the outer pull out channel 40 and locks the pull out channel to the intermediate rail 30. In other words, the sliding motion of the intermediate rail 30 is said to be synchronized with that of the pull out channel 40 when the synchronizing member 50, 60 is in this first condition. As the drawer is pushed inwards, the outer pull out channel 40 with the intermediate rail 30 locked thereon slides relative to the fixed guide 20 towards the rear portion of the article of furniture. The sliding locked together pull out channel-intermediate rail reaches a position where a longitudinal side guide ramp of the upper surface protrusion 21 of the fixed guide 20 becomes firstly engagable with the synchronizing member 50, 60 at the joint (second pivot point 53*c*, 63*c* and rounded end 52*c*, 62*c* of second arm 52, 62) where the second arm 52, 62 is pivoted to the central portion 53, 63, and subsequently, with the knob 53*b*, 63*b* of the central portion 53, 63 of the synchronizing member 50, 60. The synchronizing member 50, 60 is thereby switched to a second condition where the elbow 51*b*, 61*b* of the first arm 51, 61 is disengaged from the rear end of the outer pull out channel 40 and the central portion 53, 63 is engaged with the fixed guide protrusion 21. In this second condition of the synchronizing member 50, 60, the intermediate rail 30 is locked or 'anchored stationary' to the fixed guide 20 while the outer pull out channel 40 continues to slide rearwards until the sliding housing 70 of the pull out channel 40 abuts its limit stop.

When the drawer is in a fully closed position, the synchronizing member 50, 60 is in a second condition where the intermediate rail 30 is anchored to the fixed guide 20 with the central portion 53, 63 of the synchronizing member 50, 60 engaged with the upper surface protrusion 21 of the fixed guide 20. As the drawer is pulled outward from the article of furniture, the outer pull out channel 40 is caused to forwardly slide relative to the stationary locked together intermediate rail-fixed guide. When the sliding outer pull out channel 40 reaches a position where its rear end becomes engagable with the first arm elbow 51*b*, 61*b* of the synchronizing member 50, 60, firstly, the knob 53*b*, 63*b* on the central portion 53, 63 and subsequently, the joint (second pivot point 53*c*, 63*c* and rounded end 52*c*, 62*c* of second arm 52, 62) where the second arm 52, 62 is pivoted to the central portion 53, 63 of the synchronizing member are disengaged from the fixed guide protrusion 21. Therefore, the intermediate rail 30 is no longer locked with the fixed guide 20 and is free to slidably move. The synchronizing member 50, 60 is now said to be switched to its first condition with the first arm elbow 51*b*, 61*b* engaged to the rear end of the pull out channel 40. In other words, the intermediate rail 30 is now locked with the outer pull out channel 40 and slides forwardly together with the pull out channel.

It can be said that the central portion 53, 63 of the synchronizing member 50, 60 interacts with the upper surface fixed guide protrusion 21 so as to switch the synchronizing member from a first to a second condition and vice versa during the opening or closing action of the guide rail assembly.

Figure 9:
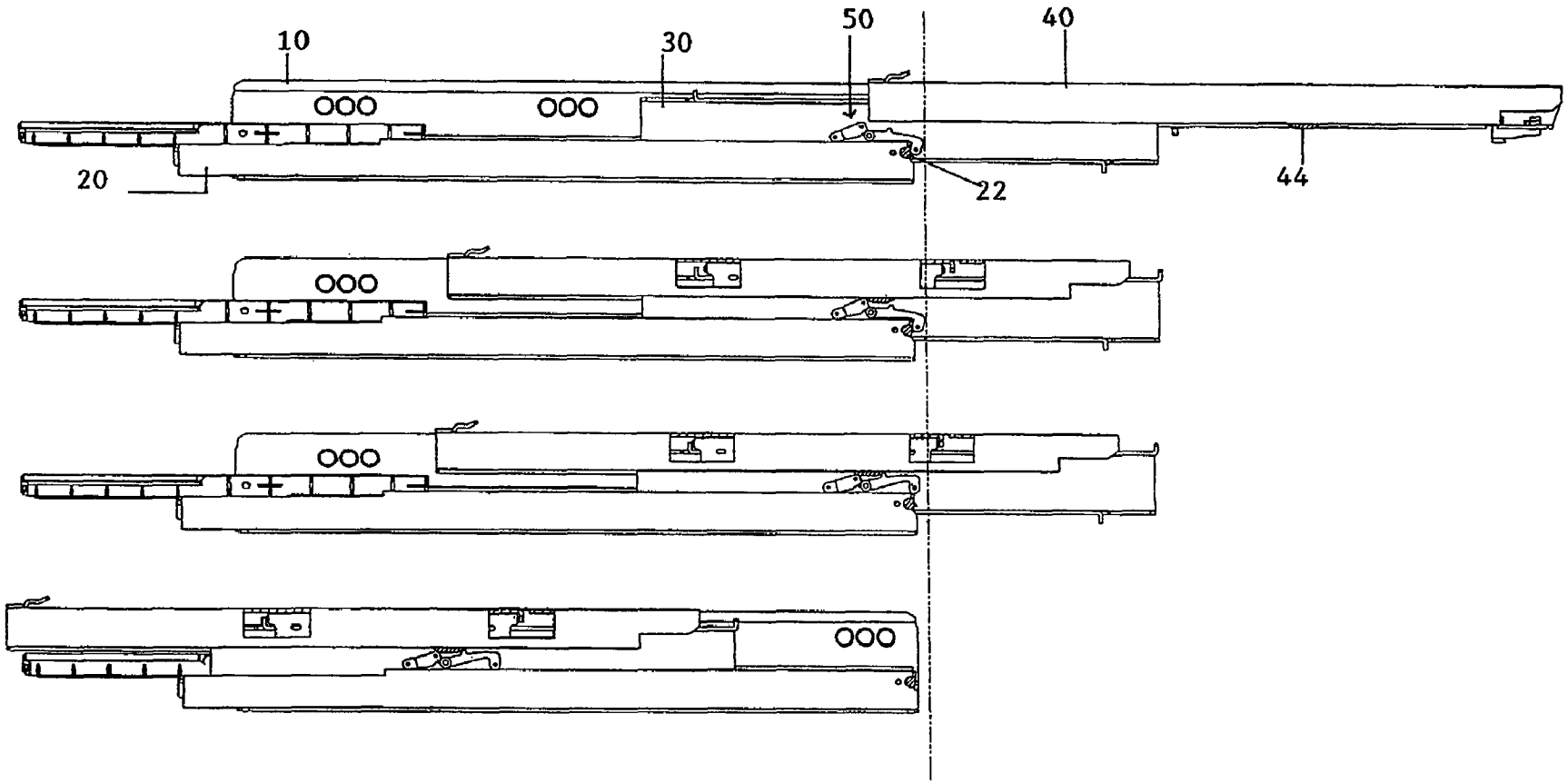
FIG. 9 shows a side view of another embodiment of the invention as the drawer is initially in a fully opened position and subsequently being pushed into a completely closed position.
Figure 10:
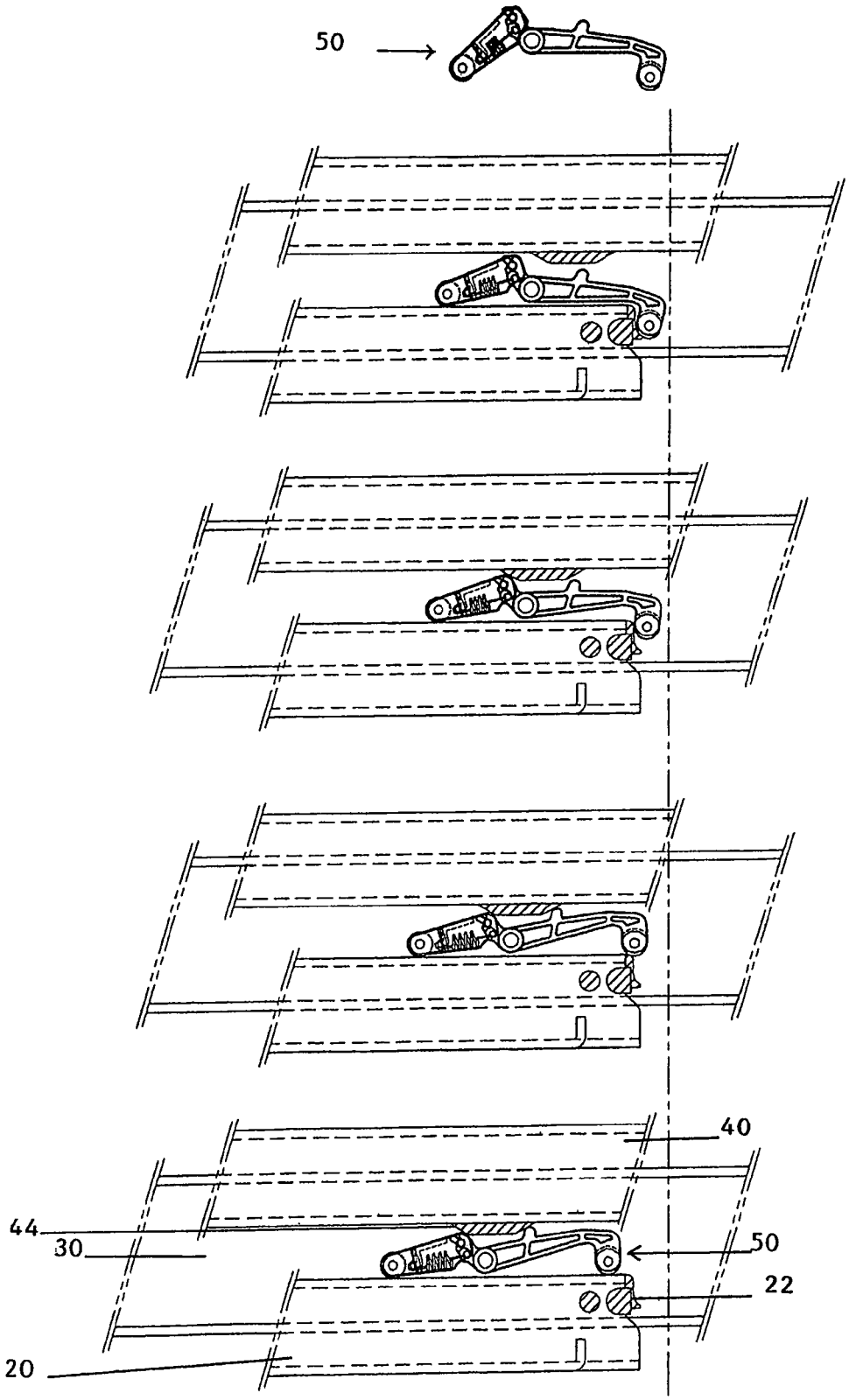
FIG. 10 is a close-up of the engagement of the synchronizing member with the front end of the fixed guide in the aspect of FIG. 9.

In another embodiment as shown in FIGS. 9 and 10, the construction of the guide rail assembly and manner of attachment to an article of furniture and drawer is similar to the above-described preferred embodiment with the exception that the outer pull out channel 40 has a protrusion 44 on its bottom surface and the fixed guide 20 has a damping part 22 disposed on its front end for engagement with the synchronizing member 50, 60.

In this embodiment, the trapezium-like shaped protrusion 44 with guide ramps on each of its longitudinal ends is disposed on the bottom surface towards the front (relative to drawer orientation) of the outer pull out channel 40. Again, this protrusion 44 may be made of any material, projects into the space within the intermediate pull out rail 30 and may also act as a retainer means for the guide rail assembly during the operational motion thereof.

Also, the front end of the fixed guide 20 is disposed to have a resilient damping part 22 that is engagable by the first arm 51, 61 of the synchronizing member 50, 60. Again, this damping part 22 may be made of any type of material that is resilient in nature and functions to dampen or eliminate the noise made when the first arm 51, 61 of the synchronizing member 50, 60 is engaged therewith.

The synchronizing member 50, 60 of this embodiment is similar in construction to that of the preferred embodiment and is also pivotably attached to the vertical web side of the intermediate rail 30 facing the side of the drawer on which the guide rail assembly is attached. The exception in this embodiment is that the synchronizing member 50, 60 is oriented on its pivot point 53*a*, 63*a* attaching it to the intermediate rail 30 such that the first arm 51, 61 is now forwardly-extending with the second arm 52, 62 rearwardly-extending. As such, the terminal rollers 51*a*, 52*a*; 61*a*, 62*a* on each of the first 51, 61 and second 52, 62 arms now enable the synchronizing member 50, 60 to travel along the upper surface of the fixed guide 20. Here, the central portion 53, 63 of the synchronizing member 50, 60 is adapted to interact with the protrusion 44 of the pull out channel 40 via its protruding knob-like portion 53*b*, 63*b*. This central portion knob 53*b*, 63*b* now obviously becomes engagable with a guide ramp of a longitudinal end of the pull out channel-protrusion 44. The elbow 51*b*, 61*b* of the forwardly-extending first arm 51, 61 is engagable with the front end of the fixed guide 20. The second arm 52, 62 is preferably removably pivoted to the central portion 53, 63 about a second pivot point 53*c*, 63*c* and biased to a position such that its terminal roller 52*a*, 62*a* is contactable with the upper surface of the fixed guide 20. Either of the above-described biasing means is conceivable in this embodiment, meaning it may be either a removable spring 52*b* or that the second arm consists of a resilient deformable portion 62*b* thereof.

In use, when the drawer is being pulled out or pushed in from a fully closed or fully extended position, into the article of furniture, the guide rail assembly having the synchronizing member 50, 60 of this embodiment again provides a synchronized sliding motion such that the intermediate rail 30 and outer pull out channel 40 are slidable over each other in a sequential manner. When the drawer is in a fully extended position, the synchronizing member 50, 60 of the intermediate rail 30 is in a first condition in which the elbow 51*b*, 61*b* of the forwardly-extending first arm 51, 61 is engaged with the front end of the fixed guide 20 and locks the intermediate rail 30 to the fixed guide 20. In other words, the intermediate rail 30 is locked or 'anchored stationary' to the fixed guide 20 when the synchronizing member 50, 60 is in a first condition. As the drawer is pushed inwards, the outer pull out channel 40 slides relative to the locked together intermediate rail-fixed guide, towards the rear portion of the article of furniture. When the sliding outer pull out channel 40 reaches a position where a longitudinal end guide ramp of its bottom surface protrusion 44 becomes engagable with the joint (second pivot point 53*c*, 63*c* and rounded end 52*c*, 62*c* of second arm 52, 62) where the second arm 52, 62 is pivoted to the central portion 53, 63 of the synchronizing member 50, 60, the synchronizing member is switched to a second condition where the elbow 51*b*, 61*b* of the first arm is disengaged from the front end of the fixed guide 20 and the central portion is now engaged with the pull out channel protrusion 44. In this synchronizing member second condition, the intermediate rail 30 is free to be slidably movable and is locked with the pull out channel 40 so that its sliding movement is synchronized with that of the pull out channel.

When the drawer is in a fully closed position, the synchronizing member 50, 60 is in a second condition where the intermediate rail 30 is locked to the outer pull out channel 40 with the central portion 53, 63 of the synchronizing member engaged with the bottom surface protrusion 44 of the pull out channel. As the drawer is pulled outward from the article of furniture, the locked together outer pull out channel-intermediate rail is caused to forwardly slide relative to the stationary fixed guide 20. When the sliding pull out channel-intermediate rail reaches a position where the first arm elbow 51*b*, 61*b* of the synchronizing member 50, 60 becomes engagable with the front end of the fixed guide 20, the joint (second pivot point 53*c*, 63*c* and rounded end 52*c*, 62*c* of second arm 52, 62) where the second arm 52, 62 is pivoted to the central portion 53, 63 of the synchronizing member 50, 60 is disengaged from the pull out channel protrusion 44. Therefore, the intermediate rail 30 is no longer locked with the pull out channel 40 but is instead now anchored stationary to the fixed guide 20. In other words, the synchronizing member 50, 60 is now said to be switched to its first condition with the first arm elbow 51*b*, 61*b* engaged to the front end of the fixed guide 20. As the drawer is pulled out further until it is fully extended, the outer pull out channel 40 continues to slide forward independent of the stationary intermediate rail 30, until its sliding housing 70 abuts its limit stop.

It can be said that the central portion 53, 63 of the synchronizing member 50, 60 interacts with the bottom surface protrusion 44 of the outer pull out channel 40 so as to switch the synchronizing member 50, 60 from a first to a second condition and vice versa during the opening or closing action of the guide rail assembly.

Figure 11:
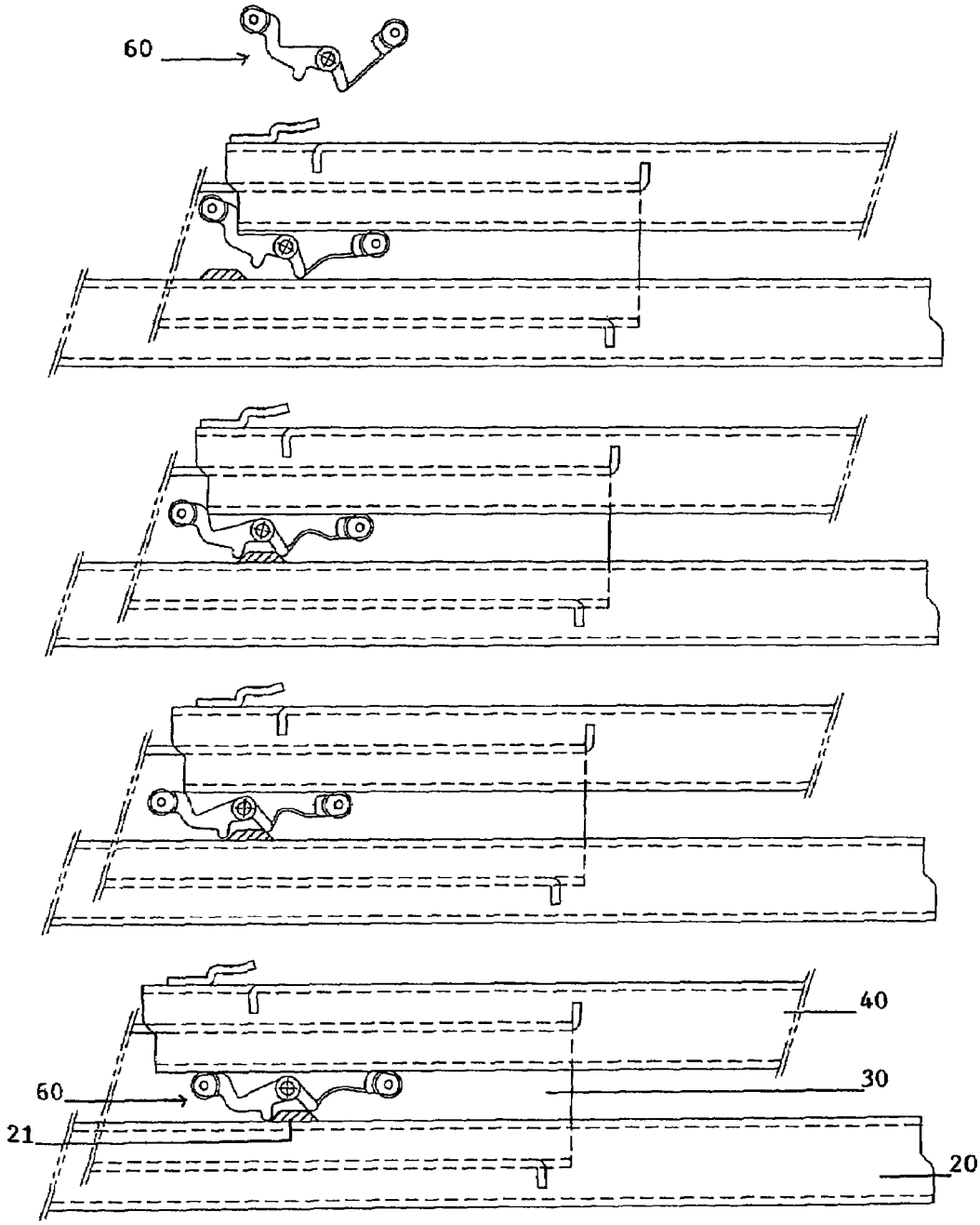
FIG. 11 is a side view close-up of the engagement of the synchronizing member of FIG. 6 with the rear end of the outer pull out channel in an embodiment of the invention.

For the preferred embodiment of FIGS. 2, 3, 7 and 8, in the case of the synchronizing member 50 having the preferred construction whereby the second arm 52 has a removable spring 52*b* as a biasing means, the terminal roller 51*a* of the rearwardly-extending first arm 51 contacts the resilient damping part 43 of the outer pull out channel 40 as the first arm elbow 51*b* engages the rear end of the pull out channel 40. In the case (shown in FIG. 11) where the synchronizing member 60 of an alternative construction is used whereby the second arm has a resiliently deformable portion 62*b* as a biasing means, the terminal roller 61*a* of the first arm 61 does not contact the damping part 43 of the outer pull out channel 40 but rather is caused to be directed away from the rear end of the pull out channel 40 as the first arm elbow 61*b* engages the pull out channel rear end.

In the embodiment of FIGS. 9 and 10, when the preferred synchronizing member 50 is used, the terminal roller 51*a* of the forwardly-extending first arm 51 contacts the resilient damping part 22 of the fixed guide 20 as the first arm elbow 51*b* engages the front end of the fixed guide 20. When the alternative synchronizing member 60 is used, the terminal roller 61*a* of the first arm 61, again, does not contact the damping part 22 of the fixed guide but rather is directed away from the fixed guide front end as the first arm elbow 61*b* engages the front end of the fixed guide 20.

In all embodiments having the resilient damping part 22, 43, the latter's function is to soften the impact between the elbowed arm 51, 61 and the corresponding front end of fixed guide 20 or rear end of outer pull out channel 40 during engagement and thereby the resultant noise.

As will be readily apparent to those skilled in the art, the present invention may easily be produced in other specific forms without departing from its scope or essential characteristics. The present embodiments are, therefore, to be considered as merely illustrative and not restrictive, the scope of the invention being indicated by the claims rather than the foregoing description, and all changes which come within therefore intended to be embraced therein.

The invention claimed is:

1. A guide rail assembly having a synchronized sliding movement for slidably opening and closing a drawer within an article of furniture, the assembly comprising a support means (10) for fixing said assembly to the article of furniture; a fixed guide (20) mounted on said support means; an intermediate pull out rail capable of sliding back and forth relative to said fixed guide; an outer pull out channel (40) for attachment to the drawer and being capable of sliding back and forth on said intermediate pull out rail relative to said intermediate pull out rail and said fixed guide, and having a protrusion (44) on the bottom surface of said outer pull out channel, wherein said protrusion projects into a space within said intermediate pull out rail; a synchronizing member (50, 60) pivotably mounted on the intermediate rail, the synchronizing member comprising a forwardly-extending first arm (51, 61) and a rearwardly-extending second arm (52, 62) that extend in generally opposing directions from a central portion (53, 63) that contains a pivot point (53*a*, 63*a*), each said arm terminating in a respective roller (51*a*, 52*a*; 61*a*, 62*a*) that enables the synchronizing member to travel along the upper surface of the fixed guide, and the first arm (51) including a bend (51*b*) to define an elbow, wherein said central portion (53, 63) interacts with said protrusion (44) so as to switch the synchronizing member, during an open or closing action of the assembly, between a first condition in which the elbow of the first arm engages the forward end of the fixed guide and locks the intermediate rail to the fixed guide, and a second condition in which the central portion is engaged by said protrusion to lock the pull out channel to the intermediate rail.

2. A guide rail assembly as claimed in claim 1, wherein said rearwardly extending second arm (52, 62) of the synchronizing member (50, 60) is pivotable relative to the central portion (53, 63) about a second pivot point (53*c*, 63*c*) and is biased to a position such that its terminal roller (52*a*, 62*a*) is contactable with the upper surface of the fixed guide (20).

3. A guide rail assembly as claimed in claim 2, wherein said biasing means comprises a removable spring (52*b*).

4. A guide rail assembly as claimed in claim 2, wherein said biasing means comprises a resiliently deformable portion (62*b*) of the synchronizing member (60).

5. A guide rail assembly as claimed in claim 1, wherein said central portion (53, 63) of the synchronizing member (50, 60) further comprises a protruding knob-like portion (53*b*, 63*b*) engagable with a longitudinal end of the protrusion (44) on the bottom surface of the outer pull out channel (40).

6. A guide rail assembly as claimed in claim 1, wherein the forward end of the fixed guide (20) further comprises a resilient damping part (22) that is engaged by the forwardly-extending first arm (51, 61) in said first condition.

7. A guide rail assembly as claimed in claim 1, wherein the protrusion (44) on the bottom surface of the outer pull out channel (40) is integral to the outer pull out channel.

8. A guide rail assembly as claimed in claim 1, wherein the protrusion (44) on the bottom surface of the outer pull out channel (40) further comprises a guide ramp on each longitudinal end.

9. A guide rail assembly having a synchronized sliding movement for slidably opening and closing a drawer within an article of furniture, the assembly comprising a support means (10) for fixing said assembly to the article of furniture; a fixed guide (20) mounted on said support means, and having a protrusion (21) on the upper surface of said fixed guide; an intermediate pull out rail capable of sliding back and forth relative to said fixed guide, wherein said protrusion projects into a space within said intermediate pull out rail; an outer pull out channel (40) for attachment to the drawer and being capable of sliding back and forth on said intermediate pull out rail relative to said intermediate pull out rail and said fixed guide; a synchronizing member (50, 60) pivotably mounted on the intermediate rail, the synchronizing member comprising a forwardly-extending second arm (52, 62) and a rearwardly-extending first arm (51, 61) that extend in generally opposing directions from a central portion (53, 63) that contains a pivot point (53*a*, 63*a*), each said arm terminating in a respective roller (51*a*, 52*a*; 61*a*, 62*a*) that enables the synchronizing member to travel along the bottom surface of the outer pull out channel (40), and the rearwardly-extending first arm (51, 61) including a bend (51*b*, 61*b*) to define an elbow, wherein said central portion interacts with said protrusion (21) so as to switch the synchronizing member, during an open or closing action of the assembly, between a first condition in which the elbow of the first arm engages the rear end of the outer pull out channel and locks the outer pull out channel to the intermediate rail, and a second condition in which the central portion is engaged by said protrusion to lock the intermediate rail to the fixed guide.

10. A guide rail assembly as claimed in claim 9, wherein said forwardly extending second arm (52, 62) of the synchronizing member (50, 60) is pivotable relative to the central portion (53, 63) about a second pivot point (53*c*, 63*c*) and is biased to a position such that its terminal roller (52*a*, 62*a*) is contactable with the lower surface of the outer pull out channel (40).

11. A guide rail assembly as claimed in claim 10, wherein said biasing means comprises a removable spring (52*b*).

12. A guide rail assembly as claimed in claim 9, wherein said biasing means comprises a resiliently deformable portion (62*b*) of the synchronizing member (60).

13. A guide rail assembly as claimed in claim 9, wherein said central portion (53, 63) of the synchronizing member (50, 60) further comprises a protruding knob-like portion (53*b*, 63*b*) engagable with a longitudinal end of the protrusion (21) on the upper surface of the fixed guide (20).

14. A guide rail assembly as claimed in claim 9, wherein the rear end of the outer pull out guide (40) further comprises a resilient damping part (43) that is engaged by the rearwardly-extending first arm (51, 61) in said first condition.

15. A guide rail assembly as claimed in claim 9, wherein the protrusion (21) on the upper surface of the fixed guide (20) is integral to the fixed guide.

16. A guide rail assembly as claimed in claim 9, wherein the protrusion (21) on the upper surface of the fixed guide (20) further comprises a guide ramp on each longitudinal end.

17. A guide rail assembly as claimed in claim 9, wherein the intermediate pull out rail (30) has an I-shaped vertical cross-section.

18. A guide rail assembly as claimed in claim 9, wherein the fixed guide (20) and outer pull out channel (40) each further comprises a slidable housing (70) having a plurality of rollers that enables the intermediate rail (30) to be slidable on the fixed guide and the outer pull out channel to be in turn slidable on the intermediate rail.

* * * * *